US005787734A

United States Patent [19]

Viñas

[11] Patent Number: 5,787,734

[45] Date of Patent: Aug. 4, 1998

[54] MACHINE FOR THE WET TREATMENT OF FABRICS

[75] Inventor: Jaume Anglada Viñas, Matadepera, Spain

[73] Assignee: Turbang Prototips, S.L., Polinyà, Spain

[21] Appl. No.: 726,397

[22] Filed: Oct. 2, 1996

[30] Foreign Application Priority Data

Oct. 16, 1995 [ES] Spain ..... 9502070

[51] Int. Cl.[6] ..... D06B 3/28

[52] U.S. Cl. ..... 68/18 F; 68/178

[58] Field of Search ..... 68/18 F, 20, 177, 68/178

[56] References Cited

U.S. PATENT DOCUMENTS

| | | | |
|---|---|---|---|
| 4,545,221 | 10/1985 | Daniel et al. | 68/18 R |
| 4,793,014 | 12/1988 | Luigi | 68/177 X |
| 5,046,209 | 9/1991 | Keilhack | 68/177 X |
| 5,431,031 | 7/1995 | Vinas | 68/178 X |
| 5,623,738 | 4/1997 | Biancalani | 68/178 X |

FOREIGN PATENT DOCUMENTS 0 653 508 A2 5/1995 European Pat. Off. .

*Primary Examiner*—Philip R. Coe
*Attorney, Agent, or Firm*—McGlew and Tuttle

[57] ABSTRACT

A machine for the wet treatment of fabrics, having one module with two containers, each container having two vessels. Each module contains two pairs of alternately operating hydraulic drive means, comprising a fixed structure attached by a hinge to a cover movable between a closed position and an open position. There is, further, a fixed restraining member, situated above the cover and an air bag, comprised between the cover and the fixed member. The air bag may alternately be in an inflated position, in which it urges the cover to remain in the closed position, and a deflated position, in which it releases the cover towards the open position.

11 Claims, 4 Drawing Sheets

MACHINE FOR THE WET TREATMENT OF FABRICS

FIELD OF THE INVENTION

The invention relates to a machine for the wet treatment of fabrics, by way of a supply of liquid, which comprises at least one module having two containers and each container having a first vessel and a second vessel having respective open upper ends, there being for each module two pairs of alternately operating hydraulic drive means, respectively located over the open upper ends of adjacent vessels of different containers, each drive means comprising a fixed structure, having a liquid inlet port and a moveable, lid-like, cover disposed above said fixed structure; there being, for the liquid exit towards the fabric facing the drive means, a longitudinal passage which is determined by a moderate spacing between a first lip of said fixed structure and a second lip of said moveable cover.

RELATED PRIOR ART

Spanish patent 9302046, and corresponding U.S. Pat. No. 5,431,031 discloses machines of this type, although having more than one module, in which the fabric is treated in "open width" state, i.e. the drawbacks of having to treat fabrics in "rope form", i.e. a fabric piece rolled up lengthwise with the ends joined together, are overcome. These machines give a very satisfactory result, since to achieve a sufficient contact time of the fabric with the liquid, large sized installations, which obviously involve a notable increase in cost, are not required. Furthermore, undesirable stress and stretching of the treated fabric are avoided. It should be added that these machines are not onerous.

Nevertheless, these known machines do have their drawbacks; one of them is that in the drive means, particularly in the part thereof from which the liquid which drives the fabric along springs, there are formed accumulations of the impurities proper to the fabric and jetting of the liquid is consequently hindered. Therefore, these machines must be stopped with relative frequency for opening of the cover and removal of the accumulated impurities.

SUMMARY OF THE INVENTION

It is an object of the invention to overcome the said drawbacks, while maintaining the advantages of the known machines and overcoming moreover difficulties in the treatment liquid filtering system and improving the circulation of the fabric to be treated in the path over the drive means. This object is achieved by a machine of the type indicated at the beginning which is characterized in that said cover and said structure are connected together by a hinge member forming an axis for the pivoting of the cover between a closed working position, wherein said moderate spacing between said lips is maintained, and an open cleaning position, wherein said moderate spacing is increased; and in that it comprises a fixed restraining member, situated at a higher level than said cover, and an air bag, comprised between said cover and said fixed restraining member, said air bag being adapted to be alternately in a first inflated position, in which it forces said cover to be in said closed working position, and a second at least partially deflated position, wherein it releases said cover to pass to said open cleaning position.

BRIEF DESCRIPTION OF THE DRAWING

Further advantages and features of the invention will be appreciated from the following description in which without any limiting nature there is related a preferred embodiment of the invention, with reference to the enclosed drawings, in which.

DETAILED DESCRIPTION

Figure 1:
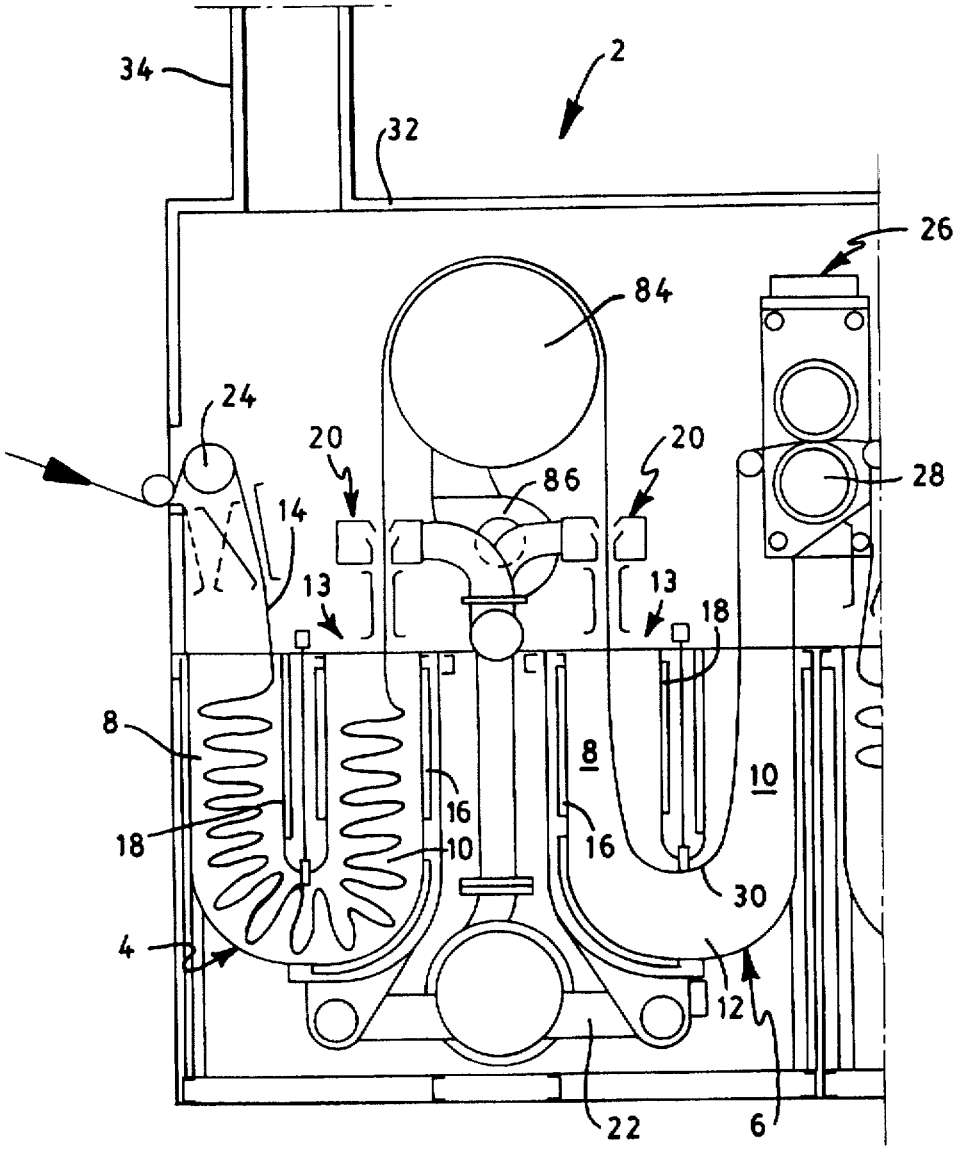
FIG. 1 is a schematic cross section view of one module of a machine for the wet treatment of fabrics according to the invention.

The machine of the invention comprises one or more modules 2 and one complete module and a small portion of the adjacent module have been shown. The desired treatment, such as scouring, bleaching, optical bleaching, dyeing, steaming, deoiling, desizing or like operation, is performed in one of these modules, while the remaining module is for rinsing the fabric, without this meaning that the rinsing operation is necessary in all treatments.

The modular constitution of the machine allows one same machine to have a first module for a specific treatment (i.e. scouring), a second module for another treatment (i.e. dyeing), a third module for a third treatment, to conclude preferably with a final rinsing module. Also contemplated is the possibility of having two or more modules (consecutive or otherwise) for one same treatment, whereby a greater treatment speed may be attained. Where the machine being used has, in certain cases, more modules than required for a particular treatment to be effected or for the amount of fabric to be treated, there is the possibility of "neutralizing" one or mode modules by feeding only clear water to them.

Each module 2 is provided with a first container 4 and a second container 6 and each container is formed by a first vessel 8 and a second vessel 10, both substantially vertical and which are in communication over a bottom portion 12. The vessels 8 and 10 have respective open upper ends 13 of substantially rectangular shape. The major dimension of the rectangle is the one disposed perpendicular to the plane in which FIG. 1 lies (whereby it is not appreciated therein), i.e. in the transverse direction of the machine. Its size is appropriate for the magnitude of the width of the fabric 14.

The prior art constituted by Spanish patent 9302046 discloses other peculiarities of the machine, such as the fact that the containers 4 and 6 are bounded by an outer partition wall 16, having a right U section and by an inner partition wall 18, also having a right U section, of lesser height and width than the outer wall. This prior art also provides information on the operation of the machine, as far as the known members thereof are concerned.

FIG. 1 shows precisely the right section of the containers 4, 6 in the longitudinal direction of the machine and this right section is preferably constant. These outer 16 and inner 18 walls are provided with a plurality of passages (not shown in the FIG.) which communicate with the outside and these passages are situated in the bottom portions of the vessels 8, 10 and over practically all of one vertical arm of the wall 16. These passages are preferably located in the vertical portions of the outer wall 16 and/or inner wall 18 of the vessels 8, 10.

Located above the open upper end of the second vessel 10 of a first container 4 of a module 2 and the open upper end of the first vessel 8 of a second container 6 of the same module 2 (i.e., contiguous vessels of two containers of one same module), there are respective pairs of hydraulic drive means 20, to be discussed more fully hereinafter.

A pumping means 22 for each module 2 takes up the liquid exiting from the passages in the containers 4, 6 and delivers it to the drive means 20. The pumping means 22 has a variable flowrate and pressure, to be able to adapt to different fabrics and different treatments. It is provided also with a not shown valve which alternately directs the liquid taken from the containers to one or the other of the drive means 20.

The machine further comprises means for passing the fabric from one container 4,6 to another and this means will also be discussed hereinafter.

There is logically an input device 24 for the gradual infeed of the fabric 14 to the machine, and an exit device for the gradual removal of the fabric, which is located on the adjacent, not shown module. Both devices comprise conventional means, the description of which is omitted.

Between both modules 2 there is an element 26 for the transfer of fabric between modules, comprising a pair of intermediate wringing rollers 28.

Each of the inner walls 18 is provided at the lower end thereof with a fabric exhaustion sensor 30, which produces reversal of the operation of the hydraulic drive means 20.

There is also contemplated a structure 32 for enclosing each module 2, whereby the removal of vapours produced during the process is permitted. Fume stacks 34 facilitate this removal.

Each hydraulic drive means 20 comprises a fixed structure 36 having a liquid intake port (not shown). Above this structure 36 there is a lid-like cover 38, which is associated with the structure 36 by a hinge member 40.

Between the structure 36 and the cover 38 there is a longitudinal passage 42 of moderate spacing which is defined by a first lip 44 (fixed, as is corresponding since it forms part of the fixed structure 36) and a second lip 46 of the cover 38.

The said hinge member 40 defines an ideal axis of pivoting and allows the cover 38 to rotate between a closed working position (left hand side of FIG. 2) wherein the said moderate spacing is maintained and an open cleaning position (right hand side of FIG. 2 and FIG. 3) wherein the size of said moderate spacing of the longitudinal passage 42 is increased. To prevent undue spillage of liquid, there is provided a longitudinal gasket 47 situated adjacent the hinge member 40 and between the structure 36 and the cover 38.

Figure 2:
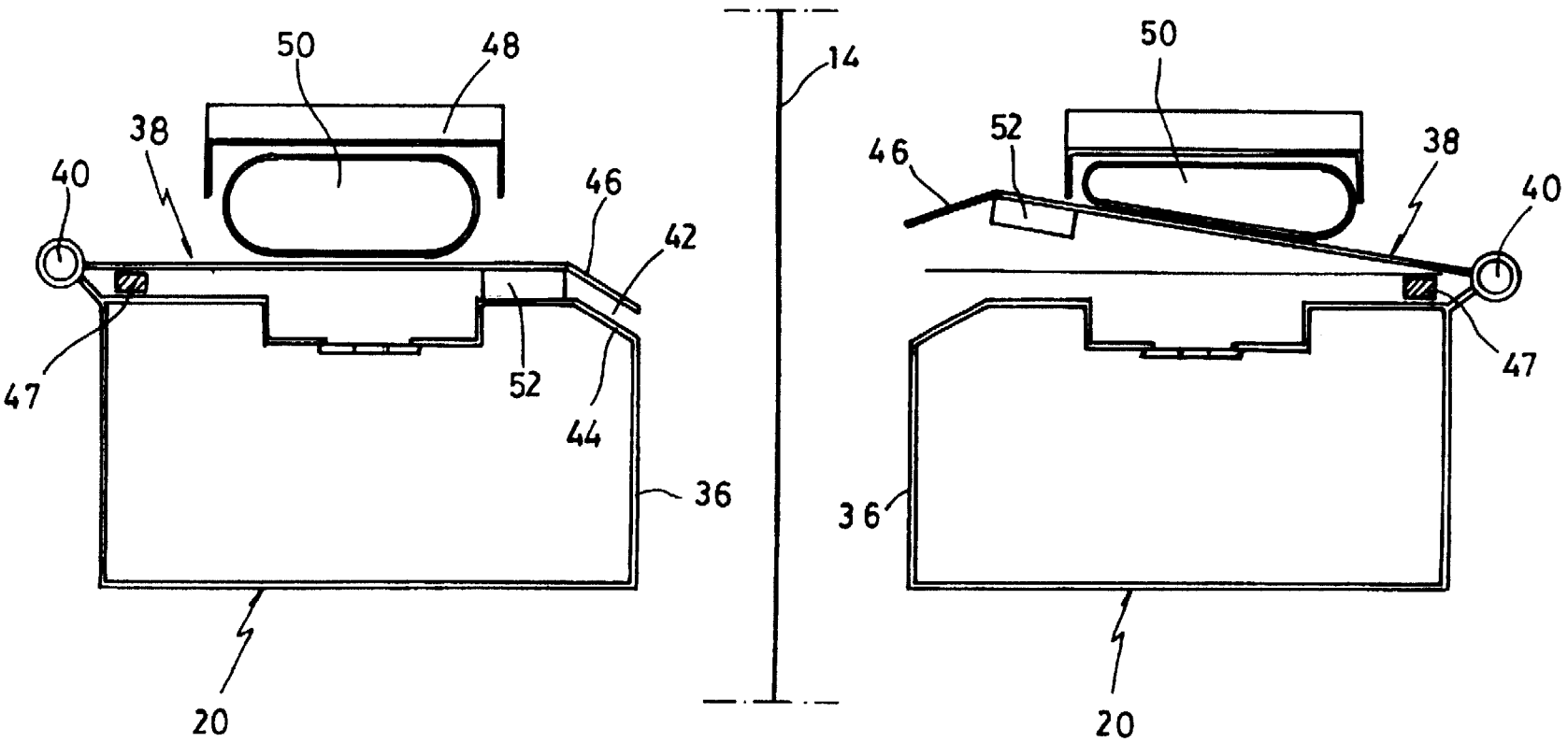
FIG. 2 is a schematic cross section view of the two hydraulic drive means of one same module, the left hand side one being in the working position and the right hand side one being in the cleaning position; the fabric to be treated has also been shown schematically between both drive means.
Figure 3:
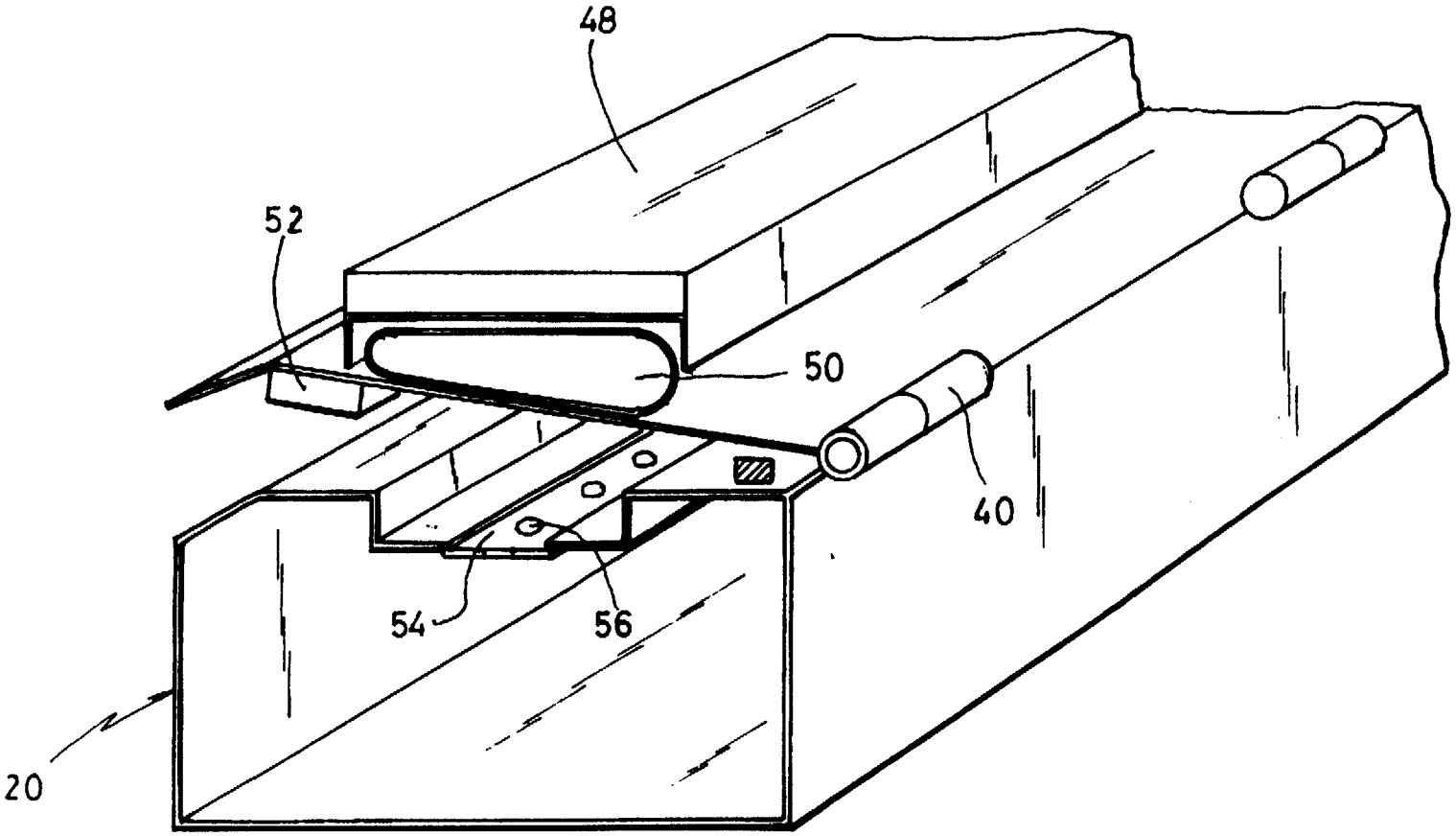
FIG. 3 is a perspective cross section view of a drive means in the cleaning position.

Above the cover 38 there is a fixed restraining member 48 and between the latter fixed member and the cover 38 there is an air-bag 50 which may be in a first inflated position (left hand side of FIG. 2) and a second, at least partially, deflated position (right hand side of FIG. 2 and FIG. 3). The passage from one state to the other is achieved by machine control means and this control means may be automatic and programmable.

When the machine is in operation, the treatment liquid which is driven by the pumping means 22 and is forced through the longitudinal passage 42, exercises a force against the lower surface of the cover 38, such that the latter tends to rotate towards the said open position. When the air bag 50 is in the first inflated position, this pivoting is prevented and the machine continues performing the desired treatment normally.

Nevertheless, the action of the liquid on the fabric frequently causes the appearance of lint, hairs and fly and these impurities tend to accumulate in the longitudinal passage 42 and hinder the liquid flow, in certain cases to the extent of requiring stoppage of the machine.

With the hydraulic drive means 20 of the invention, the solution to the problem cited in the foregoing paragraph is obtained immediately by causing the air bag 50 to pass to the second, deflated position. Thereby, the liquid force causes the cover 38 to move to the open cleaning position and the greater space existing between both lips 44 and 46 allows the liquid easily to entrain the said lint, hairs and fly.

So that the treatment liquid may have a regular exit through the longitudinal passage 42, there are provided regularly spaced apart vertical flaps 52 located substantially orthogonal to the direction of the fabric 14 facing the hydraulic drive means 20. These flaps 52 preferably extend from the cover 38. The existence of these flaps 52 logically increases the problems caused by the waste mentioned above, although these problems are quite easily solved with the described shape of the hydraulic drive means 20.

Also with the purpose of achieving a regular liquid outflow, there is provided a wall 54 (FIG. 3) between the liquid access to the drive means 20 and the longitudinal passage 42. This wall is provided with aligned orifices 56 also regularly spaced apart in correspondence with the vertical flaps 52, preferably in such a way that each orifice 56 is equidistant from the nearest two flaps.

Figure 6:
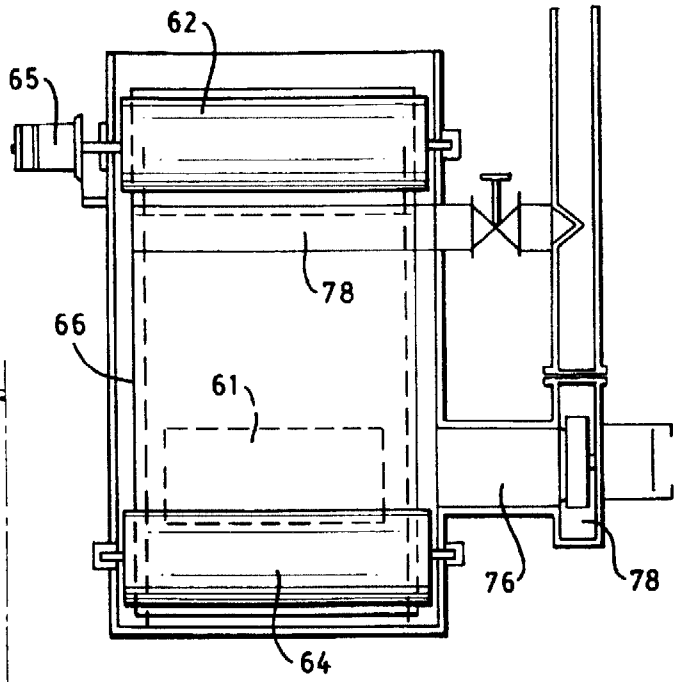
FIG. 6 is a schematic cross section front elevation view of the device of FIG. 4.
Figure 5:
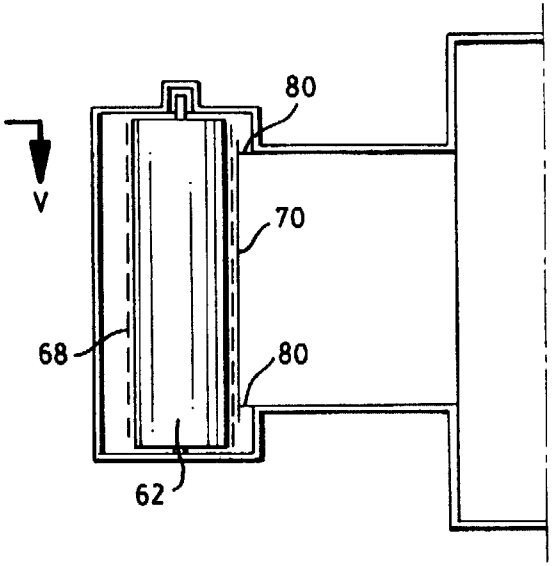
FIG. 5 is a schematic overhead plan view of the arrangement of FIG. 4.
Figure 4:
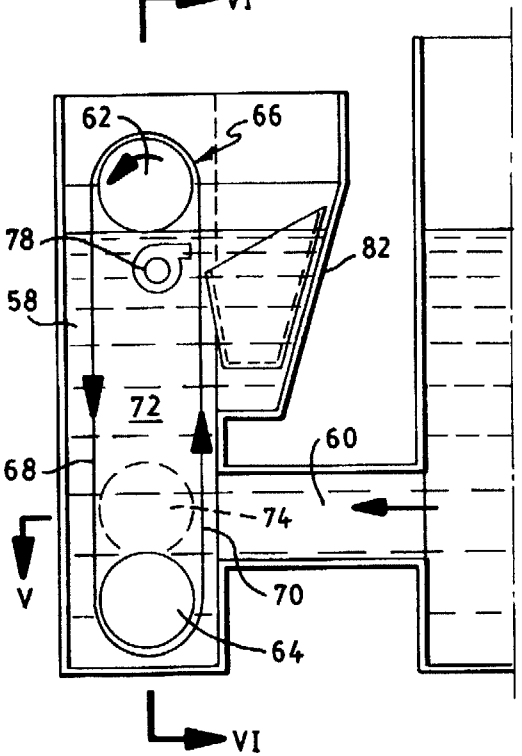
FIG. 4 is a schematic side elevation view of the filtering arrangement of the machine.

The machine is preferably provided with an effective filter arrangement for the complete or partial removal of the impurities (FIGS. 4 to 6). The arrangement comprises a filter chamber 58 into which the impurity-bearing liquid from the machine flows through the passage 60 defining a port 61 (FIG. 6). In the chamber 58 there are a first or upper rotary roller 62 and a second or lower rotary roller 64 of which one (preferably the first roller 62) is a drive roller, connected to a motor 65. Both rollers 62, 64 have mutually parallel shafts and an endless belt 66 formed by a filter wire cloth is wrapped around both rollers and driven by its contact with the rollers 62, 64.

At all times, this endless belt 66 defines a first run 68 extending between both rollers 62, 64 and a second run 70, such that the second run 70 is interposed between the first run 68 and the port 61 of the passage 60. Between the rollers 62, 64 and the runs 68, 70 there is defined a space 72 which is in communication over the exit port 74 (FIG. 4) with an liquid exit passage 76 (FIG. 6), from where a pump 78 returns the liquid to the machine. The belt 66 is preferably wider than the port 61 (FIG. 6) and at least partial sealing means 80 (FIG. 5) is provided tending to direct almost all the liquid to the inside of the space 72.

Inside the space 72 there is an spray nozzle 78 which jets liquid (preferably water) against an internal transverse zone of the second run 70 of the endless belt 66. The impurity-containing liquid entering the chamber 58 through the access port 61 encounters the second run 70 of the wire cloth forming the endless belt 66. The liquid passes through the cloth and the impurities remain on the cloth. For this reason, the liquid practically free of impurities flows into the space 72 and exits therefrom through the exit port 74.

The belt continues circulating and the impurities collected thereon subsequently pass across the spray nozzle 78 and the liquid jetted from the spray nozzle removes the impurities from the band which fall in the liquid outside the space 72 and are preferably collected in a basket 82 which may be easily removed.

The means for passing the fabric 14 from one container to another 4, 6, preferably comprises a cylindrical drum 84 rotatable about a horizontal axis transverse to the machine and therefore parallel to the pivoting axis of the cover 38. The drum 84 is situated above the two pairs of hydraulic drive means 20 of one same module 2 and furthermore defines two ideal vertical planes which are tangential to the drum 84 and each of which extends between the two drive means 20 of one same pair.

In this way an easy path is obtained for the fabric, according to which the fabric 14 rises in the space to be found between one pair of drive means, wraps round the top half of the drum 84 and descends through the space to be found between the other pair of drive means 20. Conventional drive means for the drum 84 allow the drum 84 to rotate alternately in both directions. Furthermore, these drive means functions in such a way that the reversal of the rotation of the drum 84 is completely synchronized with the means (particularly the fabric exhaustion sensor 30) causing reversal of the operation of the hydraulic drive means 20.

The drum 84 is preferably provided on the outer surface thereof with a plurality of reliefs disposed on generating lines and which facilitate the fabric movement.

It is also contemplated that the drum 84 be perforate and that the inside thereof be in communication with a fan 86 blowing air through the perforations, whereby the rubbing between the fabric 14 and the drum 84 is reduced to a minimum. The air communication between the drum 84 and the fan 86 is preferably adjustable.

What I claim is:

1. A machine for the wet treatment of fabrics, by way of a supply of liquid, which comprises at least one module having two containers and each container having a first vessel and a second vessel having respective open upper ends, there being for each module two alternately operating hydraulic drive means, respectively located over the open upper ends of adjacent vessels of different containers, each drive means comprising a fixed structure, having a liquid inlet port and a moveable, lid-like, cover disposed above said fixed structure; there being, for the liquid exit towards the fabric facing the drive means, a longitudinal passage which is determined by a moderate spacing between a first lip of said fixed structure and a second lip of said moveable cover, characterized in that said cover and said structure are connected together by a hinge member forming an axis for the pivoting of the cover between a closed working position, wherein said moderate spacing between said lips is maintained, and an open cleaning position, wherein said moderate spacing is increased; and in that it comprises a fixed restraining member, situated at a higher level than said cover, and an air bag, comprised between said cover and said fixed restraining member, said air bag being adapted to be alternately in a first inflated position, in which it forces said cover to be in said closed working position, and a second at least partially deflated position, wherein it releases said cover to pass to said open cleaning position.

2. The machine of claim 1, wherein said drive means comprises a longitudinal rubber seal situated between said fixed structure and said cover in the proximity of said hinge member.

3. The machine of claim 1, wherein said cover is provided with a plurality of regularly spaced apart vertical flaps having an orientation generally orthogonal to the orientation of the fabric opposite the drive means.

4. The machine of claim 1, wherein in the path of the liquid from said access port to said longitudinal liquid exit passage there is inserted a wall having a plurality of aligned orifices for the passage of said liquid.

5. The machine of claim 4, wherein each of said orifices is situated substantially equidistant from two adjacent flaps.

6. The machine of claim 1 having a filter arrangement for at least partially removing impurities, wherein said arrangement comprises: (a) a filter chamber having a liquid access port and a liquid exit port; (b) first and second rotating rollers having generally parallel axes of rotation housed inside said chamber; (c) an endless belt of filter wire cloth, susceptible of being entrained by said rollers and defining at all times: a first run extending between both rollers; a second run, also extending between both rollers and which lies between said first run and said access port, which it faces; and a space delimited between said rollers and said first and second runs, said exit port opening out into said space; and (d) a spray nozzle situated in said space and adapted to spray said liquid against an internal transverse area of said second run.

7. The machine of claim 6, wherein between said belt and said access port there are partial sealing means urging the liquid from said access port inside said space.

8. The machine of claim 6, comprising a collector basket situated adjacent said spray nozzle, the basket and nozzle being separated by said second run of said belt and said collector basket being removable.

9. The machine of claim 6, wherein said first roller is disposed at the top of the chamber and is a drive roller.

10. The machine of claim 6, wherein said internal transverse area of said second run is comprised between said access port and said first roller.

11. The machine of claim 1, comprising a cylindrical drum which: (a) is rotatable about a horizontal axis parallel to said axis of pivoting of said movable cover; (b) is situated above two pairs of hydraulic drive means; (c) determines two ideal planes vertically tangential to the drum, such that each of said ideal planes passes between both drive means of one same pair; and in that it is provided drive means for said drum, adapted to cause said drum to rotate alternately in both directions.

* * * * *